US011280043B2

(12) United States Patent
Welch

(10) Patent No.: US 11,280,043 B2
(45) Date of Patent: Mar. 22, 2022

(54) ADDITIVE DISPENSING FOR WASHING MACHINE APPLIANCES

(71) Applicant: Haier US Appliance Solutions, Inc., Wilmington, DE (US)

(72) Inventor: Aaron Lee Welch, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 132 days.

(21) Appl. No.: 16/568,544

(22) Filed: Sep. 12, 2019

(65) Prior Publication Data

US 2021/0079582 A1 Mar. 18, 2021

(51) Int. Cl.

| | |
|---|---|
| ***D06F 39/02*** | (2006.01) |
| ***D06F 39/08*** | (2006.01) |
| *D06F 103/18* | (2020.01) |
| *D06F 105/04* | (2020.01) |
| *D06F 105/42* | (2020.01) |

(52) U.S. Cl.

CPC ..... *D06F 39/028* (2013.01); *D06F 39/022* (2013.01); *D06F 39/087* (2013.01); *D06F 39/088* (2013.01); *D06F 2103/18* (2020.02); *D06F 2105/04* (2020.02); *D06F 2105/42* (2020.02)

(58) Field of Classification Search

None

See application file for complete search history.

(56) References Cited

U.S. PATENT DOCUMENTS

| | | | | |
|---|---|---|---|---|
| 2004/0163183 | A1* | 8/2004 | Kim | D06F 39/087 8/137 |
| 2008/0229517 | A1* | 9/2008 | Amarillas | D06F 37/12 8/159 |
| 2017/0292217 | A1* | 10/2017 | Kulkarni | D06F 39/022 |

FOREIGN PATENT DOCUMENTS

| | | | |
|---|---|---|---|
| CN | 107780151 | A | 3/2018 |
| CN | 109208233 | A | 1/2019 |
| EP | 1688529 | A1 | 8/2006 |

OTHER PUBLICATIONS

Espacenet translation CN107780151, Automatic detergent filling system for washing machine, 2018 (Year: 2018).*

* cited by examiner

*Primary Examiner* — Cristi J Tate-Sims

(74) *Attorney, Agent, or Firm* — Dority & Manning, P.A.

(57) ABSTRACT

Additive dispensing, as provided herein, may include opening a water supply valve for a first index according to a predetermined fill index and directing a wash additive from an additive dispenser to a water supply conduit during an additive segment. The method may also include blocking the wash additive from the additive dispenser to the water supply conduit during a non-additive segment, detecting a fluid level within a wash tub following the first index, and comparing the detected fluid level to a target fluid level. The method may further include opening the water supply valve for a second index based on comparing the detected fluid level within the wash tub to the target fluid level, directing the wash additive from the additive dispenser to the water supply conduit during an additive segment, and blocking the wash additive from the additive dispenser to the water supply conduit during a non-additive segment.

20 Claims, 8 Drawing Sheets

ADDITIVE DISPENSING FOR WASHING MACHINE APPLIANCES

FIELD OF THE INVENTION

The present subject matter relates generally to washing machine appliances, and more particularly to additive dispensing in washing machine appliances.

BACKGROUND OF THE INVENTION

Washing machine appliances generally include a tub for containing water or wash fluid (e.g., water and detergent, bleach, or other wash additives). A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of wash fluid is directed into the tub in order to wash or rinse articles within the wash chamber. One or more fluid additives may be added to the wash fluid to enhance the cleaning or other properties of the wash fluid. The fluid additives may be in powder or concentrated liquid form, and may be added to a dispenser box of the washing machine appliance by, for example, a user of the washing machine appliance. The dispenser box may contain various chambers for containing different additives (e.g., wash detergent and softener).

However, in order to ensure proper additive concentrations, users must carefully measure the proper additive amount for each cycle, considering factors such as the size and type of the load, the temperature of the water, and the selected wash cycle. Although some washing machine appliances attempt to automatically estimate an appropriate amount (e.g., volume or mass) of additive based on a particular load, difficulties often arise. For instance, existing appliances generally require additional steps that must be performed prior to or during the wash cycle in order to evaluate the particular size of the load or type of fabrics included in the load. Such additional steps often consume additional energy and lengthen the time required to wash a load. Since many consumers generally want to conserve energy and wash clothes in as quick a time as possible, these existing appliances and their methods may be undesirable.

Accordingly, a washing machine appliance or method for additive dispensing that improves delivery of additives, such as detergent, is desirable. More particularly, a washing machine appliance or method for additive dispensing that automatically (e.g., without further user input) provides a suitable additive volume for various loads without significantly increasing the overall wash time would be especially desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a washing machine appliance is provided. The method may include opening a water supply valve for a first index according to a predetermined fill index and directing a wash additive from an additive dispenser to a water supply conduit during an additive segment of the first index according to a predetermined additive segment of the predetermined fill index. The method may also include blocking the wash additive from the additive dispenser to the water supply conduit during a non-additive segment of the first index, detecting a fluid level within a wash tub following the first index, and comparing the detected fluid level within the wash tub to a target fluid level. The method may further include opening the water supply valve for a second index according to the predetermined fill index based on comparing the detected fluid level within the wash tub to the target fluid level, directing the wash additive from the additive dispenser to the water supply conduit during an additive segment of the second index, and blocking the wash additive from the additive dispenser to the water supply conduit during a non-additive segment of the second index.

In another exemplary aspect of the present disclosure, a washing machine appliance is provided. The washing machine appliance may include a cabinet, a wash tub, a wash basket, an additive dispensing assembly, and a controller. The wash tub may be positioned within the cabinet. The wash basket may be rotatably mounted within the wash tub. The wash basket may define a wash chamber for receiving articles for washing. The additive dispensing assembly may be positioned within the cabinet and configured to provide wash fluid to the wash tub. The additive dispensing assembly may include a water supply valve conduit and an additive dispenser. The water supply conduit may extend between the water supply valve and the wash tub. The additive dispenser may be being in selective fluid communication with the water supply conduit upstream of the wash tub. The controller may be in operative communication with the additive dispensing assembly. The controller may be configured to initiate a washing operation. The washing operation may include opening the water supply valve for a first index according to a predetermined fill index and directing a wash additive from the additive dispenser to the water supply conduit during an additive segment of the first index according to a predetermined additive segment of the predetermined fill index. The washing operation may also include blocking the wash additive from the additive dispenser to the water supply conduit during a non-additive segment of the first index, detecting a fluid level within the wash tub following the first index, and comparing the detected fluid level within the wash tub to a target fluid level. The washing operation may further include opening the water supply valve for a second index according to the predetermined fill index based on comparing the detected fluid level within the wash tub to the target fluid level, directing the wash additive from the additive dispenser to the water supply conduit during an additive segment of the second index, and blocking the wash additive from the additive dispenser to the water supply conduit during a non-additive segment of the second index.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
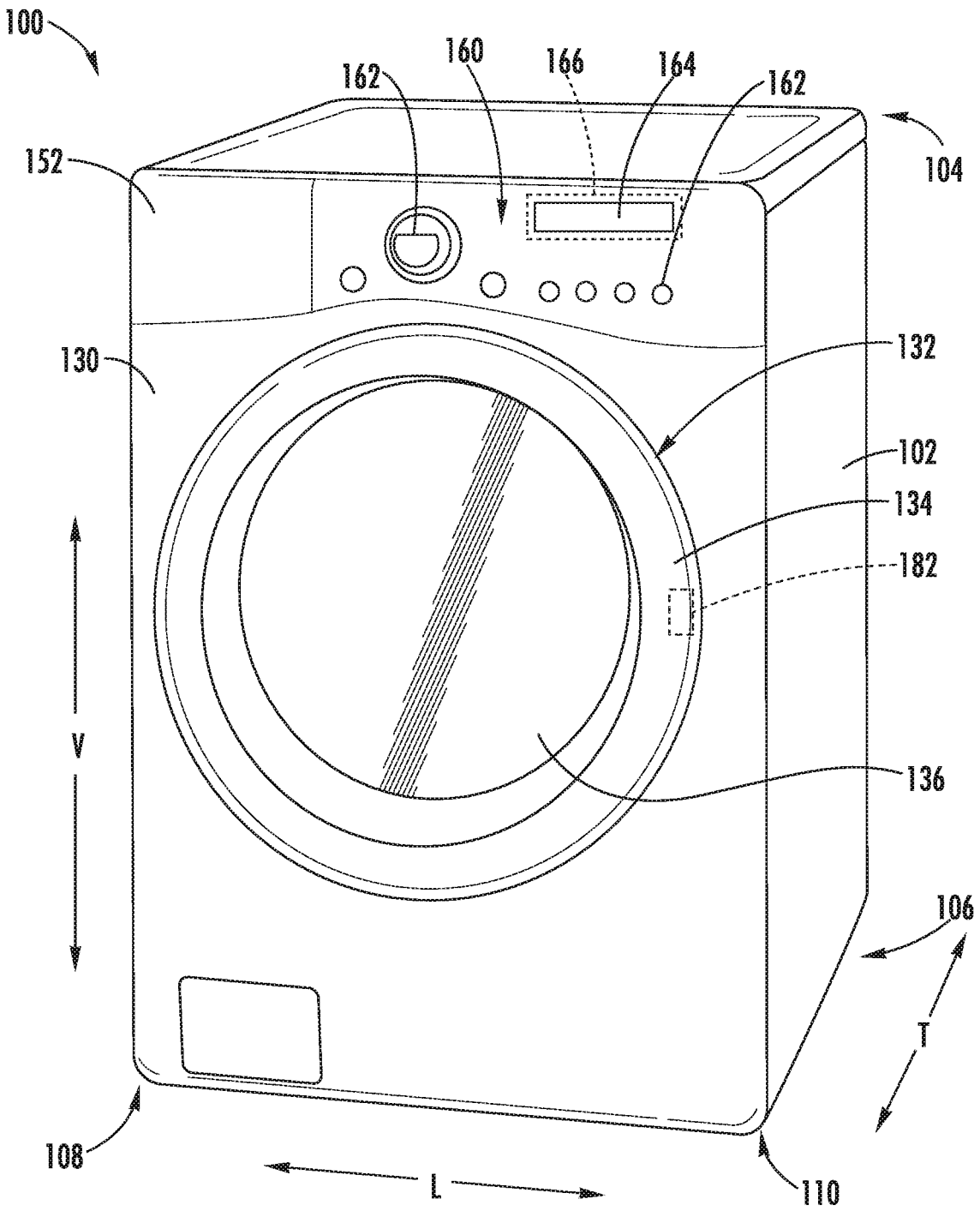
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The term "or" is generally intended to be inclusive (i.e., "A or B" is intended to mean "A or B or both"). The terms "first," "second," and "third" may be used interchangeably to distinguish one element from another and are not intended to signify location or importance of the individual elements.

Figure 2:
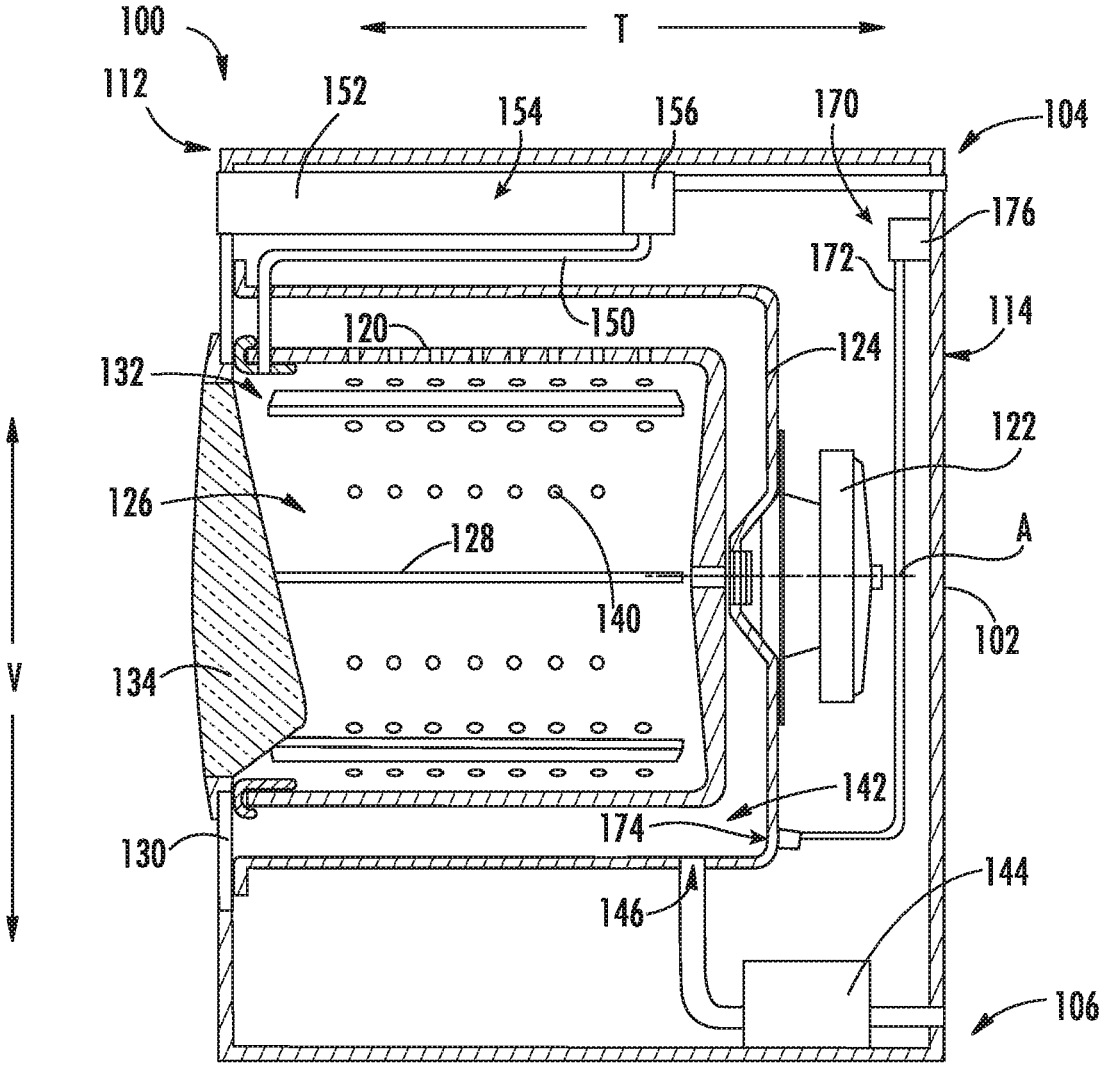
FIG. 2 provides a cross-sectional side view of the exemplary washing machine appliance of FIG. 1.
Figure 3:
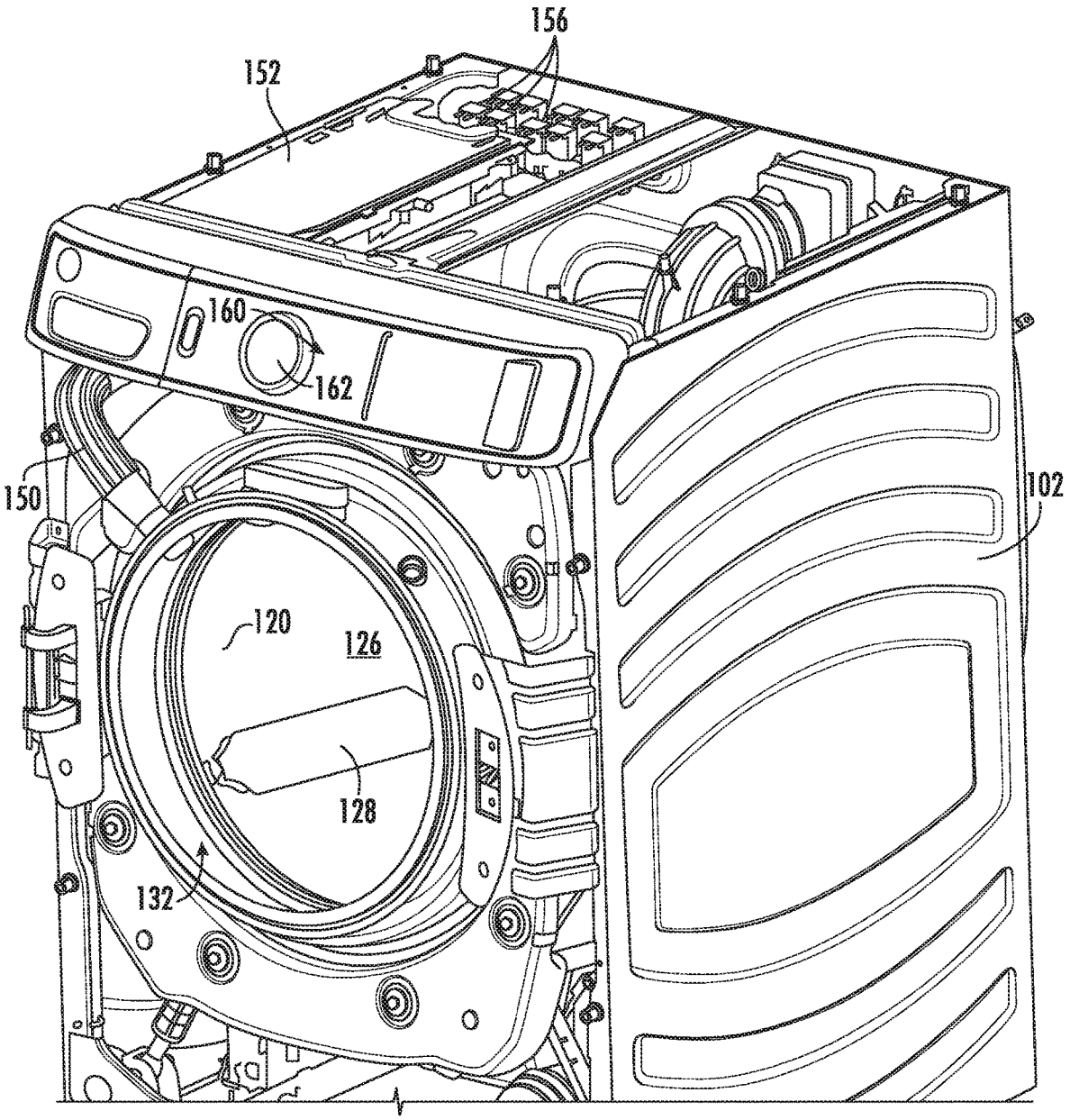
FIG. 3 provides a perspective view of the exemplary washing machine appliance of FIG. 1, wherein a portion of the cabinet has been removed for clarity.

Referring now to the figures, FIG. 1 is a perspective view of an exemplary horizontal axis washing machine appliance 100, and FIG. 2 is a side cross-sectional view of washing machine appliance 100. FIG. 3 is a perspective view of washing machine appliance 100 wherein a front panel 130 of the cabinet 102 has been removed for clarity.

As illustrated, washing machine appliance 100 generally defines a vertical direction V, a lateral direction L, and a transverse direction T, each of which is mutually perpendicular, such that an orthogonal coordinate system is defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

A wash tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Wash tub 124 is substantially fixed relative to cabinet 102 such that it does not rotate or translate relative to cabinet 102.

A wash basket 120 is received within wash tub 124 and defines a wash chamber 126 that is configured for receipt of articles for washing. More specifically, wash basket 120 is rotatably mounted within wash tub 124 such that it is rotatable about an axis of rotation A. According to the illustrated embodiments, the axis of rotation A is substantially parallel to the transverse direction T. In this regard, washing machine appliance 100 is generally referred to as a "horizontal axis" or "front load" washing machine appliance 100.

While described in the context of a specific embodiment of front load washing machine appliance 100, using the teachings disclosed herein it will be understood that front load washing machine appliance 100 is provided by way of example only. Other washing machine appliances having different configurations, different appearances, or different features may also be utilized with the present subject matter as well (e.g., vertical axis washing machines).

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation or a rinse cycle of washing machine appliance 100). According to the illustrated embodiments, motor assembly 122 is a pancake motor. However, it should be appreciated that any suitable type, size, or configuration of motor may be used to rotate wash basket 120 according to alternative embodiments.

As shown in FIGS. 1 and 2, cabinet 102 also includes a front panel 130 that defines, at least in part, an opening 132 that permits user access to wash basket 120 of wash tub 124. More specifically, washing machine appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to a wash tub 124 and a closed position (FIG. 1) prohibiting access to wash tub 124. Optionally, a lock assembly 182 may be fixed to cabinet 102 to selectively lock or hold a free end of the door 134 to cabinet 102 when door 134 is in the closed position (e.g., during certain operations or wash cycles).

In some embodiments, a window 136 in door 134 permits viewing of wash basket 120 when door 134 is in the closed position (e.g., during operation of washing machine appliance 100). Door 134 also includes a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments. Additionally or alternatively, a front gasket or baffle may extend between tub 124 and the front panel 130 about the opening 132 covered by door 134, further sealing tub 124 from cabinet 102.

As shown, wash basket 120 defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through plurality of perforations 140. In some embodiments, a pump assembly 144 is located beneath wash tub 124 for gravity assisted flow when draining wash tub 124 (e.g., via a drain 146). Pump assembly 144 may also be configured for recirculating wash fluid within wash tub 124.

In some embodiments, washing machine appliance 100 includes an additive dispenser or spout 150. For example, spout 150 may be in fluid communication with a water supply in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated, an additive container or drawer 152 may be mounted (e.g., slidably or movably mounted) within front panel 130. Generally, detergent drawer 152 may receive a wash additive (e.g., detergent, fabric softener, bleach, or any other suitable liquid or powder) and direct the wash additive to wash chamber 126 during certain operations or wash cycle phases of washing machine appliance 100. According to exemplary embodiments, detergent drawer 152 is also fluidly coupled to spout 150 to facilitate the complete and accurate dispensing of wash additive.

In optional embodiments, a bulk reservoir 154 is included with or defined by detergent drawer 152 within cabinet 102. Bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. One or more reservoir valves 156 may be mounted in fluid communication with additive container 152 or reservoir 154. Moreover, reservoir valves 156 may be configured for selective delivery of the fluid additive from bulk reservoir 154 to wash tub 124. Optionally, one or more pumps (not pictured) may be in fluid communication with container 152 or reservoir 154 to selectively motivate additives or wash fluid to wash tub 124.

In certain embodiments, a level sensor 170 is mounted within cabinet 102 and in operable communication with wash tub 124 to detect (e.g., directly or indirectly) a volume of wash fluid within wash tub 124. For instance, as illustrated, level sensor 170 may include or be provided as a pressure-detection assembly. In some such embodiments, the pressure-detection assembly is in fluid communication with tub 124 (e.g., at sump 142). Optionally, the pressure-detection assembly may include a balance pipe 172 that extends into wash tub 124 at an inlet 174 defined proximal to or at a bottom end of wash tub 124 (e.g., within sump). A pressure sensor 176 may be mounted above inlet 174, such as above wash tub 124. Pressure sensor 176 may include any suitable structure for measuring pressure, such as a force collector or resonant sensor, as is generally understood. During use in optional embodiments, as wash fluid fills tub 124, at least a portion of the wash fluid may compress a column of air within balance pipe 172, generating a new pressure that is detected and measured at pressure sensor 176.

In some embodiments, a control panel 160 including a plurality of input selectors 162 is coupled to front panel 130. Control panel 160 and input selectors 162 may collectively form a user interface input for operator selection of machine cycles and features. For example, in exemplary embodiments, a display 164 indicates selected features, a countdown timer, or other items of interest to machine users.

Operation of washing machine appliance 100 is generally controlled by a controller or processing device 166. In some embodiments, controller 166 is in operative communication with (e.g., electrically or wirelessly connected to) control panel 160 for user manipulation to select washing machine cycles and features. In response to user manipulation of control panel 160, controller 166 operates the various components of washing machine appliance 100 to execute selected machine cycles and features (e.g., as part of a washing operation).

Controller 166 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122 and level sensor 170, may be in operative communication with controller 166 via one or more signal lines or shared communication busses. Additionally or alternatively, other features, such as an electronic lock assembly 182 for door 134 may be in operative communication with controller 166 via one or more other signal lines or shared communication busses.

In exemplary embodiments, during operation of washing machine appliance 100, laundry items are loaded into wash basket 120 through opening 132, and a wash cycle is initiated through operator manipulation of input selectors 162. For example, a wash cycle may be initiated such that wash tub 124 is filled with water, detergent, or other fluid additives (e.g., via additive dispenser 150 during a fill phase). One or more valves (not shown) can be controlled by washing machine appliance 100 to provide for filling wash basket 120 to the appropriate level for the mass of articles being washed or rinsed. Optionally, the fill phase may be performed according to a predetermined index. In particular, wash fluid may be directed to the wash tub 124 in discrete indices or segments (e.g., measured as a set volume of wash fluid or period of time in which wash fluid is flowed to tub 124). Thus, filling the wash tub 124 may be performed by indexing the volume of wash fluid. After each index or segment, the volume of water within the wash tub 124 may be measured. If a desired volume of wash fluid within wash tub 124 has not yet been reached, a new index or segment may be executed.

By way of example, once wash basket 120 is properly filled with fluid, the contents of wash basket 120 can be agitated (e.g., with ribs 128) for an agitation phase of laundry items in wash basket 120. During the agitation phase, the basket 120 may be motivated about the axis of rotation A at a set speed (e.g., first speed or tumble speed). As the basket 120 is rotated, articles within the basket 120 may be lifted and permitted to drop therein.

After the agitation phase of the washing operation or wash cycle is completed, wash tub 124 can be drained (e.g., through a drain phase). Laundry articles can then be rinsed (e.g., through a rinse phase) by again adding fluid to wash tub 124, depending on the particulars of the wash cycle selected by a user. Ribs 128 may again provide agitation within wash basket 120. One or more spin phases may also be used. In particular, a spin phase may be applied after the wash cycle or after the rinse cycle in order to wring wash fluid from the articles being washed. During a spin phase, basket 120 is rotated at relatively high speeds. For instance, basket 120 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 120 increases its rotational velocity such that the plaster speed maintains the articles at a generally fixed position relative to basket 120.

After articles disposed in wash basket 120 are cleaned (or the wash cycle otherwise ends), a user can remove the articles from wash basket 120 (e.g., by opening door 134 and reaching into wash basket 120 through opening 132).

Figure 4:
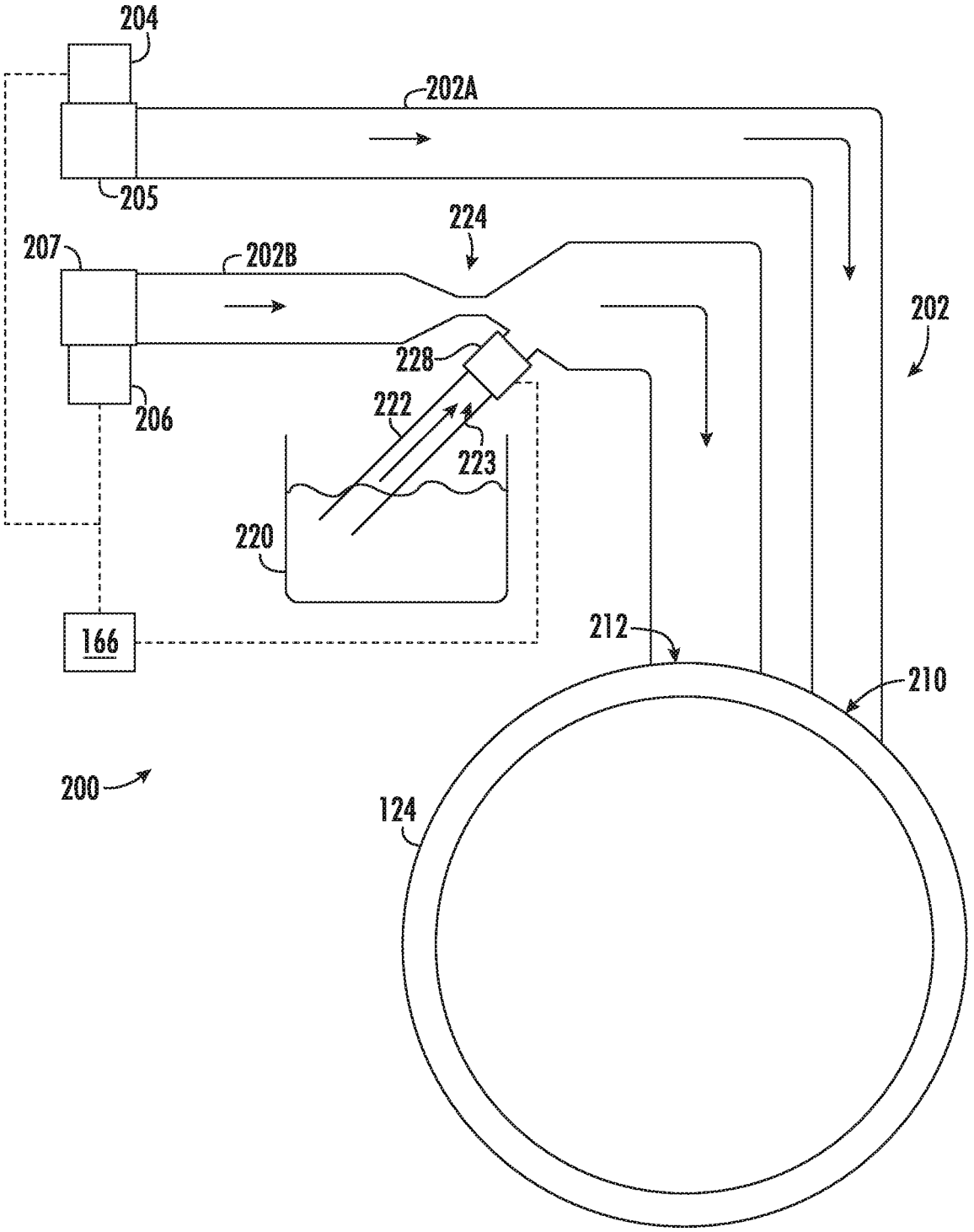
FIG. 4 provides a schematic view of an additive dispensing assembly for a washing machine appliance according to exemplary embodiments of the present subject disclosure.
Figure 5:
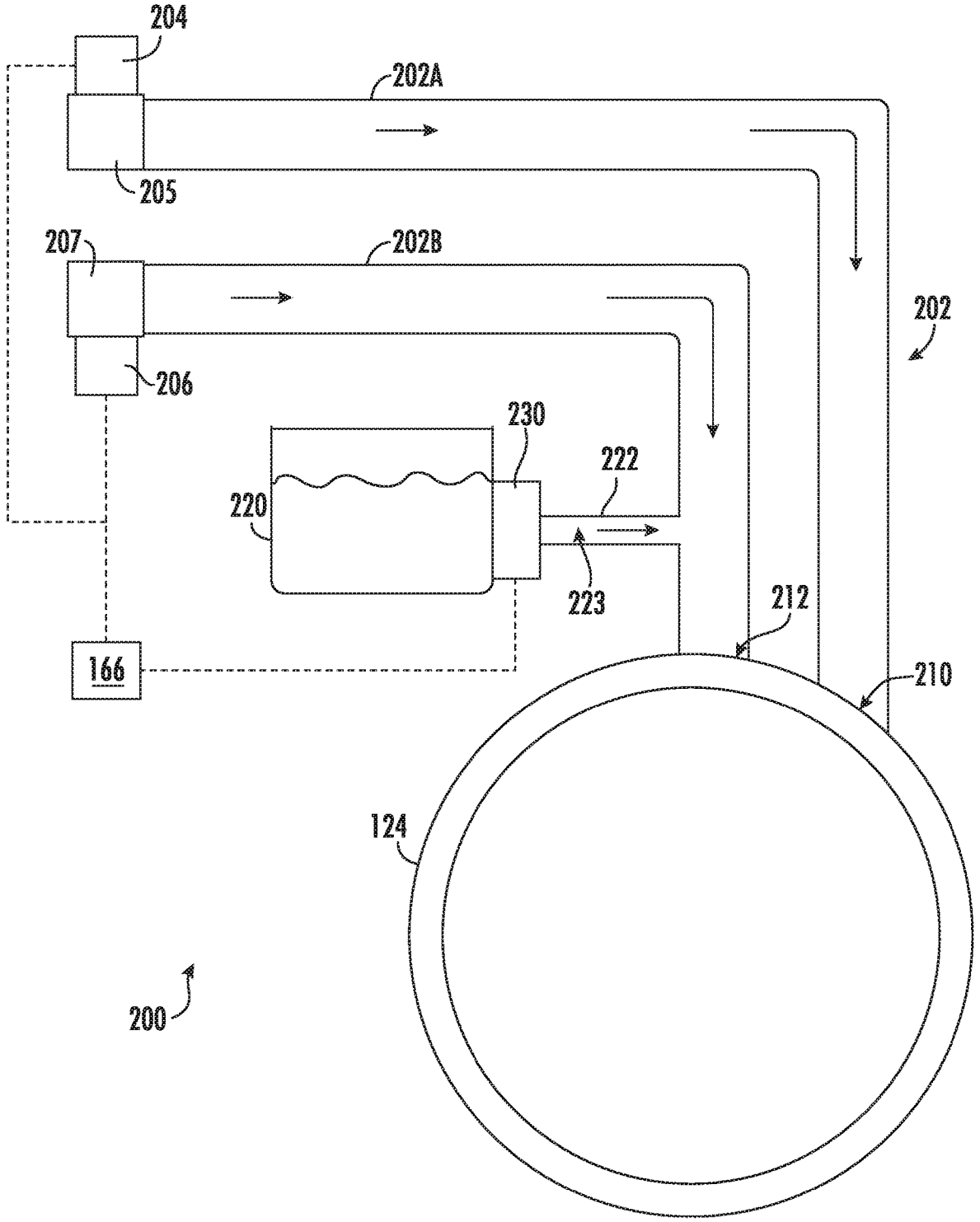
FIG. 5 provides a schematic view of an additive dispensing assembly for a washing machine appliance according to exemplary embodiments of the present subject disclosure.
Figure 8:
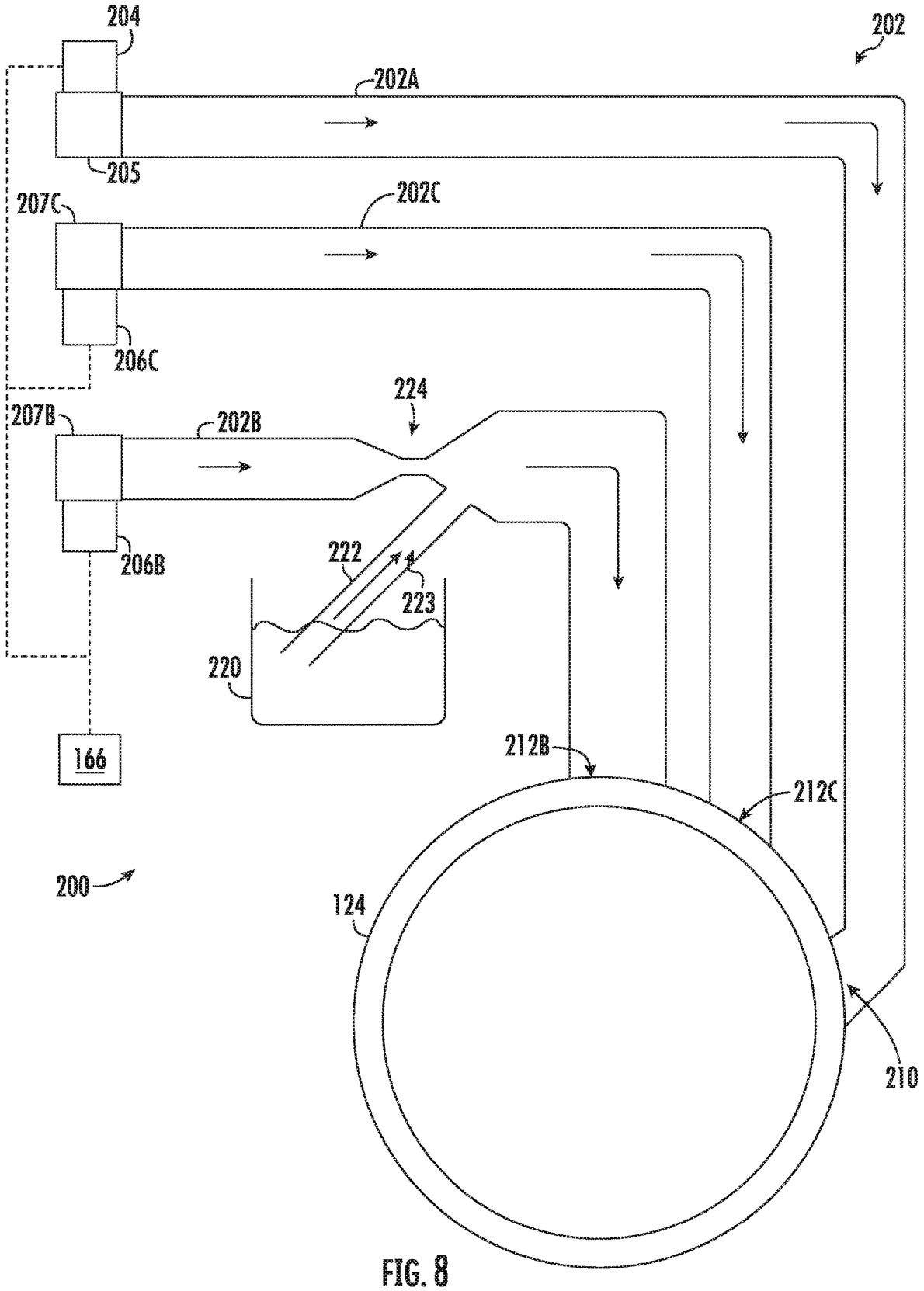
FIG. 8 provides a schematic view of an additive dispensing assembly for a washing machine appliance according to exemplary embodiments of the present subject disclosure.

Referring now to FIGS. 4, 5, and 8, an additive dispensing assembly 200 for an appliance, such as washing machine appliance 100, will be described in more detail. Although the discussion below refers to additive dispensing assembly 200 for washing machine appliance 100 (e.g., including spout 150 or reservoir 154), one skilled in the art will appreciate that the features and configurations described may be used for other additive dispensers in other washing machine appliances as well. For example, additive dispensing assembly 200 may be positioned elsewhere within cabinet 102, may have a different components or configurations, and may dispense water, detergent, or other additives. Other variations and modifications of the exemplary embodiments described below are possible, and such variations are contemplated as within the scope of the present disclosure.

Referring now specifically to FIG. 4, an exemplary embodiment of additive dispensing assembly 200 will be described in detail. As shown, water or wash fluid is provided to wash tub 124 through a water supply conduit set 202 (e.g., having a hot water conduit 202A or a cold water conduit 202B). As an example, water supply conduit set 202 may receive hot and cold water from a hot water inlet 204 and a cold water inlet 206, respectively. Hot water inlet 204 may be provided on or at a hot water supply, such as a domestic or commercial hot water tank. Cold water inlet 206 may be provided on or at a cold water supply, such as a well or municipal water-supply network.

In order to dispense wash fluid at the desired temperature, hot and cold water may be selectively dispensed in ratios that produce the desired wash fluid temperature. For example, the flow of hot water through hot water inlet 204 may be selectively adjusted using a hot water solenoid valve 205. Moreover, the flow of cold water through cold water inlet 206 may be selectively adjusted using a cold water solenoid valve 207. In some embodiments, controller 166 is electrically coupled to one or more of solenoid valves 205, 207. According to one or more wash conditions, the flow of water through one or both of hot water solenoid valve 205 or cold water solenoid valve 207 may be increased or decreased. For instance, one or both of hot water solenoid valve 205 or cold water solenoid valve 207 may be selectively controlled to provide water at a predetermined temperature based on at least one of the selected wash cycle, the soil level of the articles to be washed, and the article type.

As illustrated, water supply conduit set 202 may extend to (e.g., terminate at) wash tub 124. In exemplary embodiments, cold water conduit 202B and hot water conduit 202A extend in fluid parallel from their respective water inlets 204 and 206. Optionally, cold water conduit 202B and hot water conduit 202A may connect to wash tub 124 at discrete water nozzles 212 and 210. In other words, cold water conduit 202B may fluidly connect to wash tub 124 through a cold water nozzle 212 while hot water conduit 202A fluidly connects to wash tub 124 through a hot water nozzle 210 that is spaced apart from the cold water nozzle 212. Alternatively, hot water conduit 202A and cold water conduit 202B may join together upstream of the wash tub 124 and connect to wash tub 124 through a mutual dispensing nozzle (not pictured).

Water supply conduit set 202 may connect to wash tub 124 in any manner suitable for dispensing water or wash fluid into wash tub 124. For example, one or more dispensing nozzles 210 or 212 may have a tapered or narrowed diameter from its respective conduit 202A or 202B. Alternatively, one or more conduits may simply terminate at wash tub 124 with no change in diameter, or one or more conduits may have a Venturi-shaped end.

Additive dispensing assembly 200 may further include an additive dispenser 220 (e.g., a reservoir, such as reservoir 154, for storing wash additive). In this regard, additive dispenser 220 may be configured to receive one or more wash additives. More particularly, according to an example embodiment, additive dispenser 220 is a reservoir that is intended to store sufficient wash additives for multiple wash cycles in order to avoid requiring the user to add a measured quantity of wash additive prior to each wash cycle. Wash additive may be either a liquid or particulate material (e.g., a liquid, a particulate, or a combination of a liquid and a particulate).

Additive dispenser 220 is fluidly connected to (e.g., in fluid communication with) water supply conduit set 202 through an additive supply conduit 222. As shown, additive supply conduit 222 defines a delivery channel 223 that extends from additive dispenser 220 to the water supply conduit set 202 (e.g., at cold water conduit 202B). In optional embodiments, the delivery channel 223 is defined as a siphon channel that draws in wash additive from additive dispenser 220 when water flows through water supply conduit set 202 (e.g., at cold water conduit 202B). For example, as water is supplied through cold water conduit 202B into wash tub 124, the flowing water may create a negative pressure within additive supply conduit 222. This negative pressure may draw in wash additive from additive dispenser 220 (e.g., in proportion to the amount of water flowing through water supply conduit set 202).

Additive supply conduit 222 may be calibrated according to a desired amount of wash additive relative to water (e.g., a maximum additive to water ratio). For instance, the siphon channel of additive supply conduit 222 may be sized and shaped to provide a selected flow rate (e.g., volumetric flow rate) of the wash additive. The selected flow rate of the wash additive may be set according to a predetermined flow rate or pressure through the water supply conduit set 202 (e.g., at cold water conduit 202B). During operation, the selected flow rate of the wash additive may be proportional to the predetermined flow rate of water through a connected portion of the water supply conduit set 202.

In some embodiments, additive dispensing assembly 200 further includes a valve 228 configured to control the flow of wash additive through additive supply conduit 222. For example, valve 228 may be a solenoid valve that is electrically coupled to controller 166. Controller 166 may selectively open and close valve 228 to allow wash additive to flow from additive dispenser 220 through additive supply conduit 222. For example, during a rinse cycle where only water is desired, valve 228 may be closed to prevent wash additive from being drawn through additive supply conduit 222. Additionally or alternatively, valve 228 may be opened for only a portion (e.g., less than all) of a predetermined index. For instance, valve 228 may be opened at the beginning of the predetermined index such that additive is drawn to water supply conduit set 202 (e.g., at cold water conduit 202B) as water flows, but then valve 228 may be closed prior to the end of the predetermined index such that no more additive is drawn to water supply conduit set 202 even as water continues to flow for a given index.

Optionally, the flow of water through valve 228 may be increased or decreased according to one or more wash conditions. In other words, the opening through valve 228 may be variable according to multiple predetermined open positions (e.g., a large open position, middle or default open position, or small open position). For instance, valve 228 may be selectively controlled based on at least one of the selected wash cycle, the soil level of the articles to be washed, and the article type. Optionally, a user may manually select a specific predetermined open position if the dispensing assembly 200 is found to be dispensing an inadequate amount of additive (e.g., when in the middle or default open position). Thus, a user may have the option to override or tailor the level of additive within the predetermined index according to the user's preference.

In exemplary embodiments, additive supply conduit 222 is fluidly connected to water supply conduit set 202 (e.g., at cold water conduit 202B) through a Venturi nozzle 224. Venturi nozzle 224 is positioned downstream from a water inlet (e.g., cold water inlet 206) and receives the delivery channel 223 of additive supply conduit 222. The additive supply conduit 222 and Venturi nozzle 224 may be configured (e.g., sized and shaped) to ensure the desired amount of wash additive is supplied for a given water flow rate through at least a portion of water supply conduit set 202 (e.g., at cold water conduit 202B). For example, by adjusting the diameter of the additive supply conduit 222 (or the opening through valve 228) and the flow restriction of Venturi nozzle 224, the volumetric flow rate of wash additive may be adjusted.

According to the illustrated exemplary embodiments of FIG. 4, cold water conduit 202B is fluidly connected to wash tub 124 through dispensing nozzle 212, and additive supply conduit 222 is fluidly connected to cold water conduit 202B through Venturi nozzle 224. As described above, nozzles (e.g., 212, 224) may be shaped in a manner suitable for injecting wash fluid into wash tub 124 and wash additive into water supply conduit set 202, respectively.

As illustrated, additive supply conduit 222 is fluidly connected to (e.g., in fluid communication with) cold water conduit 202B upstream of dispensing nozzle 212. In this manner, the flowing water may entrain, mix, and dissolve the wash additive to form a wash fluid prior to dispensing into wash tub 124 through dispensing nozzle 212.

During operation, additive dispensing assembly 200 may selectively add a wash additive from additive dispenser 220 in proportion to the amount of water flowing through, for example, cold water conduit 202B. Moreover, water is provided from cold water inlet 206 and hot water inlet 204 to achieve the desired rate and temperature. This flow rate and temperature may be controlled by controller 166 or may be manually adjusted by the user. In the exemplary embodiments of FIG. 4, valve 228 may be moved to an open position as water flows into the cold water conduit 202B past Venturi nozzle 224, creating a negative pressure in additive supply conduit 222. This negative pressure draws in wash additive from additive dispenser 220. The wash additive travels through additive supply conduit 222 and is injected into water supply conduit set 202 (e.g., at cold water conduit 202B) by Venturi nozzle 224. The water traveling through water supply conduit set 202 entrains, mixes, and dissolves the wash additive to create a wash fluid that is dispensed into wash tub 124. Notably, the concentration of wash additive in the wash fluid may be proportional to the amount of water delivered to wash tub 124.

Turning especially to FIG. 5, further embodiments of dispensing assembly 200 include a secondary pump 230 in fluid communication with additive dispenser 220. For example, secondary pump 230 may be positioned upstream from water supply conduit set 202 (e.g., at cold water conduit 202B). Additionally or alternatively, secondary pump 230 may be positioned downstream of additive dispenser 220 (e.g., at or along additive supply conduit 222). Secondary pump 230 may be any suitable fluid-motivating pump (e.g., peristaltic pump, positive displacement pump, impeller pump, etc.), as is generally understood.

In some embodiments, secondary pump 230 is operatively (e.g., electrically or wirelessly) coupled to controller 166. Controller 166 may selectively activate secondary pump 230 and halt activation of secondary pump 230 to motivate or direct wash additive to flow from additive dispenser 220 through additive supply conduit 222. For instance, during a rinse cycle where only water is desired, activation of secondary pump 230 may be halted to prevent wash additive from being directed through additive supply conduit 222. Additionally or alternatively, secondary pump 230 may be activated for only a portion (e.g., less than all) of a predetermined index. For instance, secondary pump 230 may be activated at the beginning of the predetermined index such that additive is motivated to water supply conduit set 202 (e.g., at cold water conduit 202B) as water flows, but then activation may be halted or stopped prior to the end of the predetermined index such that no more additive is motivated to water supply conduit set 202 (e.g., at cold water conduit 202B) even as water continues to flow.

Optionally, the flow of water through secondary pump 230 may be increased or decreased according to one or more wash conditions. Additionally or alternatively, the secondary pump 230 may be a variable speed pump to vary the flow rate of additive motivated through additive supply conduit 222 (e.g., a high flow rate, middle or default flow rate, or low flow rate). For instance, secondary pump 230 may be selectively controlled based on at least one of the selected wash cycle, the soil level of the articles to be washed, and the article type. Optionally, a user may manually select a specific flow rate if the dispensing assembly 200 is found to be dispensing an inadequate amount of additive (e.g., when in the middle or default flow rate).

Referring now specifically to FIG. 8, still further embodiments of dispensing assembly 200 include separate conduits for cold water (e.g., in isolation) and for a fluid mixture. In some such embodiments, water or wash fluid is provided to wash tub 124 through a water supply conduit set 202 that includes a hot water conduit 202A, a mixed cold water conduit 202B, and an isolated cold water conduit 202C. Water supply conduit set 202 may receive hot water from a hot water inlet 204 and cold water from a pair of cold water inlets 206B and 206C, respectively. Hot water inlet 204 may be provided on or at a hot water supply, such as a domestic or commercial hot water tank. Cold water inlets 206B and 206C may be provided on or at a cold water supply, such as a well or municipal water-supply network. Optionally, an intermediate connecting valve (e.g., three-way valve) joins 206B and 206C to a single cold water supply.

In order to dispense water or wash fluid at the desired temperature, hot and cold water may be selectively dispensed in ratios that produce the desired wash fluid temperature. For example, the flow of hot water through hot water inlet 204 may be selectively adjusted using a hot water solenoid valve 205. Moreover, the flow of cold water through cold water inlet 206 may be selectively adjusted using cold water solenoid valves 207B and 207C. In some embodiments, controller 166 is electrically coupled to one or more of solenoid valves 205, 207B, 207C. According to one or more wash conditions, the flow of water through the solenoid valves 205, 207B, 207C may be increased or decreased. For instance, the solenoid valves 205 and 207C may be selectively controlled to provide water at a predetermined temperature based on at least one of the selected wash cycle, the soil level of the articles to be washed, and the article type. The solenoid valve 207B may further be selectively controlled to mix with the water of valves 205 and 207C to reach the predetermined temperature.

As illustrated, water supply conduit set 202 may extend to (e.g., terminate at) wash tub 124. In exemplary embodiments, mixed cold water conduit 202B, isolated cold water conduit 202C, and hot water conduit 202A extend in fluid parallel from their respective water inlets 204B, 204C, and 206. Optionally, cold water conduits 202B and 202C may connect to wash tub 124 at discrete water nozzles 212B and 210C. In other words, mixed cold water conduit 202B may fluidly connect to wash tub 124 through a mixed cold water nozzle 212B while isolated cold water conduit 202C fluidly connects to wash tub 124 through an isolated cold water nozzle 212C that is spaced apart from the mixed cold water nozzle 212B. Alternatively, one or more of the conduits 202A, 202B, 202C may join together upstream of the wash tub 124 and connect to wash tub 124 through a mutual dispensing nozzle (not pictured).

In some embodiments, additive dispenser 220 is fluidly connected to (e.g., in fluid communication with) mixed cold water conduit 202B through an additive supply conduit 222. As shown, additive supply conduit 222 defines a delivery channel 223 that extends (e.g., uninterrupted) from additive dispenser 220 to mixed cold water conduit 202B. In some such embodiments, the delivery channel 223 is defined as a siphon channel that draws in wash additive from additive dispenser 220 when water flows through mixed cold water conduit 202B. For example, as water is supplied through mixed cold water conduit 202B into wash tub 124, the flowing water may create a negative pressure within additive supply conduit 222. This negative pressure may draw in wash additive from additive dispenser 220 (e.g., in proportion to the amount of water flowing through water supply conduit set 202).

Additive supply conduit 222 may be calibrated according to a desired amount of wash additive relative to water (e.g., a maximum additive to water ratio). For instance, the siphon channel of additive supply conduit 222 may be sized and shaped to provide a selected flow rate (e.g., volumetric flow rate) of the wash additive. The selected flow rate of the wash additive may be set according to a predetermined flow rate or pressure through the mixed cold water conduit 202B. During operation, the selected flow rate of the wash additive may be proportional to the predetermined flow rate of water through mixed cold water conduit 202B. Solenoid 207B may be selectively controlled to supply a desired volume of additive (e.g., mixed within water) based on at least one of the selected wash cycle, the soil level of the articles to be washed, and the article type.

In exemplary embodiments, additive supply conduit 222 is fluidly connected to mixed cold water conduit 202B through a Venturi nozzle 224. Venturi nozzle 224 is positioned downstream from cold water inlet 206B and receives the delivery channel 223 of additive supply conduit 222. The additive supply conduit 222 and Venturi nozzle 224 may be configured (e.g., sized and shaped) to ensure the desired amount of wash additive is supplied for a given water flow rate through mixed cold water conduit 202B.

Figure 6:
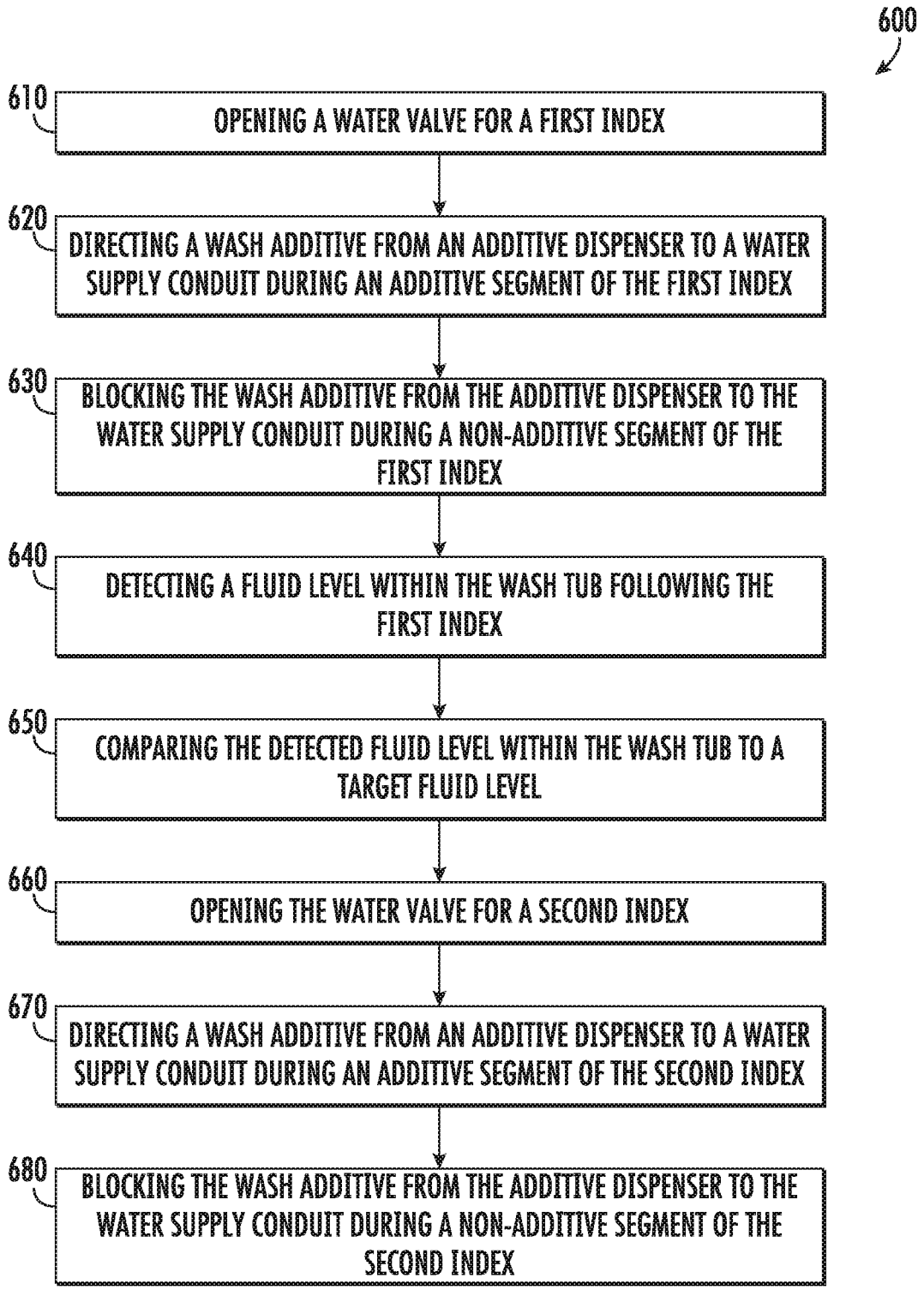
FIG. 6 provides a flow chart illustrating a method of operating a washing machine appliance according to exemplary embodiments of the present disclosure.
Figure 7:
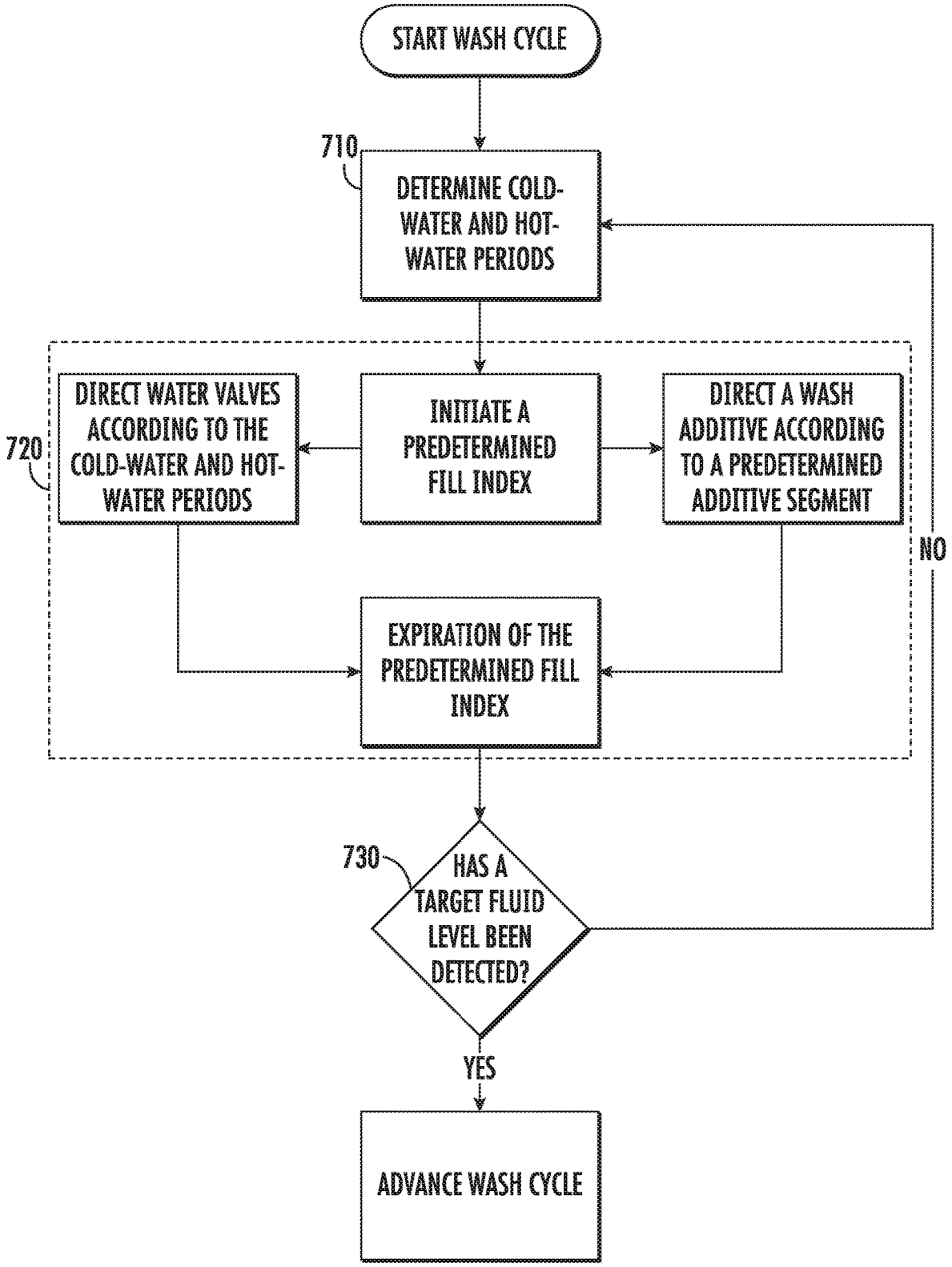
FIG. 7 provides a flow chart illustrating a method of operating a washing machine appliance according to exemplary embodiments of the present disclosure.

Referring now to FIGS. 6 and 7, various methods may be provided for use with washing machine appliances in accordance with the present disclosure. In general, the various steps of methods as disclosed herein may, in exemplary embodiments, be performed by the controller 166, which may receive inputs and transmit outputs from various other components of the appliance 100. In particular, the present disclosure is further directed to methods, as indicated by reference numbers 600 and 700, for operating a washing machine appliance 100 (e.g., as a washing operation, as described above). Such methods advantageously facilitate additive dispensing automatically tailored to a particular load (e.g., without requiring a user to specify the load size or volume of wash additive). Additionally or alternatively, such methods may be performed as water flows to the wash tub 124, advantageously limiting overall time of the wash cycle.

Turning especially to FIG. 6, at 610, the method 600 includes opening a water valve for a first index according to a predetermined fill index. Once open, water may flow to a wash tub (e.g., to a sump thereof), as described above. For instance, a cold water valve may be provided on a cold water conduit. Optionally, a hot water supply conduit may also extend to the wash tub (e.g., from a hot water valve) in fluid parallel to the cold water conduit.

The predetermined index generally provide a set period of water flow or volume. Thus, the first index may be understood as a first instance of the predetermined fill index being executed. In some embodiments, the predetermined index may provide a predetermined ratio of hot water to cold water based on a desired or selected wash fluid temperature within the wash tub. In other words, the water supply valves may be opened and closed according to the predetermined fill index. In order to meet the predetermined ratio, the cold water valve may be opened to flow cold water to the wash tub for a portion of the predetermined fill index, while the hot water valve is opened to flow hot water to the wash tub for another (e.g., different) portion of the predetermined fill index. For instance, the predetermined fill index (and thus the first index) may include both a cold water period in which the cold water valve is open, as well as a hot water period in which the hot water valve is open. Outside of the cold water period during the predetermined fill index (e.g., first index), the cold water valve may be closed. Similarly, outside of the hot water period during the predetermined fill index (e.g., first index), the hot water valve may be closed. As would be understood in light of the present disclosure, if a cold water cycle is selected, it is possible that no hot water period will be provided and predetermined fill index will only include a cold water period.

At 620, the method 600 includes directing a wash additive from the additive dispenser to the water supply conduit during a predetermined additive segment of the first index.

Generally, the predetermined fill index (and thus the first index) may include a period or portion (i.e., segment) in which wash additive is to be directed to the water supply conduit (e.g., cold water conduit). In other words, the predetermined fill index may include a predetermined additive segment. It is during this predetermined additive segment for the first index that 620 occurs.

As described above, directing the wash additive may be initiated by negative pressure through a siphon delivery channel. A Venturi nozzle may be provided downstream from the cold water valve to receive the delivery channel. The delivery channel may be calibrated to provide a selected flow rate of the wash additive (e.g., relative to the flow rate of water from the cold water valve). For instance, the selected flow rate of the wash additive may be proportional to a flow rate of the flow of water through the water supply conduit. Additionally or alternatively, an additive valve may be positioned along the delivery channel for controlling the flow of the wash additive through the delivery channel. Thus, 620 may include opening the additive valve for the predetermined additive segment.

As further described above, directing the wash additive may be initiated by positive pressure generated at a secondary pump. In some such embodiments, 620 includes activating the secondary pump for the predetermined additive segment.

At 630, the method 600 includes blocking the wash additive from the additive dispenser to the water supply conduit during a non-additive segment of the first index. In other words, during the non-additive segment, no wash additive is supplied to the wash tub, even though water may be flowing through a connected water supply conduit (e.g., cold water conduit). In some embodiments, the predetermined fill index (and thus the first index) includes a period or portion (i.e., segment) in which wash additive may be prevented from flowing to the water supply conduit (e.g., cold water conduit). In other words, the predetermined fill index may include a non-additive segment. Such a non-additive segment of 630 thus falls or occurs outside of the additive segment of 620.

In optional embodiments, 620 occurs at an initial portion of the first index and ends prior to expiration of the first index. For instance, the beginning of the first index may include the predetermined additive segment of 620, while the non-additive segment of 630 follows after the additive segment and continues until the first index expires.

If a valve is provided along the delivery channel in fluid communication with the additive dispenser, 630 may include closing the additive valve outside of the predetermined additive segment of the first index. If a secondary pump is provided in fluid communication with the additive dispenser, 630 may include halting activation of the secondary pump outside of the predetermined additive segment of the first index.

At 640, the method 600 includes detecting a fluid level within the wash tub following the first index. For instance, a height or volume of wash fluid (e.g., mixture of water and wash additive) within the wash tub may be measured. Optionally, a pressure signal may be received from a pressure sensor in communication with the wash tub. For the pressure signal, a value of pressure (e.g., correlated to wash fluid volume) may be determined.

At 650, the method 600 includes comparing the detected fluid level within the wash tub to a target fluid level. The target fluid level may be selected (e.g., by a user) or programmed within a controller of the appliance. Moreover, the target fluid level may correspond to a maximum volume of wash fluid for the cycle. Thus, failing to meet or exceed the target fluid level may indicate the wash tub has not been adequately filled (and thereby might require a new index). By contrast, meeting or exceeding the target fluid level may indicate the wash tub has been adequately filled and the method 600 may proceed or advance to another portion of a wash cycle.

Once the water supply valve is open, water or wash fluid may flow to a wash tub (e.g., to a sump thereof), as described above. For instance, a cold water valve may be provided on a cold water conduit. Optionally, a hot water supply conduit may also extend to the wash tub (e.g., from a hot water valve) in fluid parallel to the cold water conduit.

The predetermined index generally provide a set period of water flow or volume. Thus, the first index may be understood as a first instance of the predetermined fill index being executed. In some embodiments, the predetermined index may provide a predetermined ratio of hot water to cold water based on a desired or selected wash fluid temperature within the wash tub. In other words, the water supply valves may be opened and closed according to the predetermined fill index. In order to meet the predetermined ratio, the cold water valve may be opened to flow cold water to the wash tub for a portion of the predetermined fill index, while the hot water valve is opened to flow hot water to the wash tub for another (e.g., different) portion of the predetermined fill index. For instance, the predetermined fill index (and thus the first index) may include both a cold water period in which the cold water valve is open, as well as a hot water period in which the hot water valve is open. Outside of the cold water period during the predetermined fill index (e.g., first index), the cold water valve may be closed. Similarly, outside of the hot water period during the predetermined fill index (e.g., first index), the hot water valve may be closed. As would be understood in light of the present disclosure, if a cold water cycle is selected, it is possible that no hot water period will be provided and predetermined fill index will only include a cold water period.

Although 640 and 650 generally occur after 630 and after the first index, some embodiments provide for detecting a fluid level and comparing that fluid level to the target fluid level during the predetermined fill index. As wash fluid flow to the wash tub (e.g., simultaneously therewith), the method 600 may provide for continuously measuring the fluid level. If a detected or measured fluid level is determined to exceed the target fluid level, the predetermined fill index may be halted and the method may proceed or advance to another portion of a wash cycle. For instance, an agitation phase, drain phase, or rinse phase may be initiated.

At 660, the method 600 includes opening the water supply valve for a second index according to the predetermined fill index based on comparing the detected fluid level within the wash tub to the target fluid level. Optionally, 660 may be contingent on the detected fluid level at 650 being less than the target fluid level.

Once the water supply valve is open, water or wash fluid may again flow to the wash tub (e.g., to a sump thereof), as described above. For instance, as noted above, the predetermined index generally provide a set period of water flow or volume. Thus, the second index may be understood as a second instance, subsequent to the first index, of the predetermined fill index being executed. In some embodiments, the predetermined index may provide a predetermined ratio of hot water to cold water based on a desired or selected wash fluid temperature within the wash tub. In other words, the water supply valves may be opened and closed according to the predetermined fill index. In order to meet the predetermined ratio, the cold water valve may be opened to flow cold water to the wash tub for a portion of the predetermined fill index, while the hot water valve is opened to flow hot water to the wash tub for another (e.g., different) portion of the predetermined fill index. For instance, the predetermined fill index (and thus the second index) may include both a cold water period in which the cold water valve is open, as well as a hot water period in which the hot water valve is open. Outside of the cold water period during the predetermined fill index (e.g., second index), the cold water valve may be closed. Similarly, outside of the hot water period during the predetermined fill index (e.g., second index), the hot water valve may be closed. As would be understood in light of the present disclosure, if a cold water cycle is selected, it is possible that no hot water period will be provided and predetermined fill index will only include a cold water period.

At 670, the method 600 includes directing the wash additive from the additive dispenser to the water supply conduit during an additive segment of the second index.

The predetermined fill index (and thus the second index) may include a period or portion (i.e., segment) in which wash additive is to be directed to the water supply conduit (e.g., cold water conduit). In other words, the predetermined fill index may include a predetermined additive segment. It is during this predetermined additive segment for the second index that 670 occurs.

As described above, directing the wash additive may be initiated by negative pressure through a siphon delivery channel. A Venturi nozzle may be provided downstream from the cold water valve to receive the delivery channel. The delivery channel may be calibrated to provide a selected flow rate of the wash additive (e.g., relative to the flow rate of water from the cold water valve). For instance, the selected flow rate of the wash additive may be proportional to a flow rate of the flow of water through the water supply conduit. Additionally or alternatively, an additive valve may be positioned along the delivery channel for controlling the flow of the wash additive through the delivery channel. Thus, 670 may include opening the additive valve for the predetermined additive segment.

As further described above, directing the wash additive may be initiated by positive pressure generated at a secondary pump. In some such embodiments, 670 includes activating the secondary pump for the predetermined additive segment.

At 680, the method 600 includes blocking the wash additive from the additive dispenser to the water supply conduit during a non-additive segment of the second index. As noted above, the predetermined fill index may include a non-additive segment. Such a non-additive segment of 680 thus falls or occurs outside of the additive segment of 670.

In optional embodiments, 670 occurs at an initial portion of the second index and ends prior to expiration of the second index. For instance, the beginning of the second index may include the predetermined additive segment of 670, while the non-additive segment of 680 follows after the additive segment and continues until the second index expires.

If a valve is proved along the delivery channel in fluid communication with the additive dispenser, 680 may include closing the additive valve outside of the predetermined additive segment of the second index. If a secondary pump is provided in fluid communication with the additive dispenser, 680 may include halting activation of the secondary pump outside of the predetermined additive segment of the second index.

Similar to 640 and 650, a fluid level within the wash tub may be detected and compared to the target fluid level following 680. Failing to meet or exceed the target fluid level may indicate the wash tub has not been adequately filled (and thereby might require a new index following 680). By contrast, meeting or exceeding the target fluid level may indicate the wash tub has been adequately filled and the method 600 may stop indexing at 680 and proceed or advance to another portion of a wash cycle. For instance, an agitation phase, drain phase, or rinse phase may be initiated.

Turning especially to FIG. 7, at 710, the method 700 includes determining discrete cold water and hot water periods for a predetermined fill index after starting a wash cycle. Generally, the cold water and hot water periods may correspond to the total time or portion of the predetermined fill index in which a respective cold water valve and hot water valve should be opened to meet a selected wash fluid temperature within the wash tub. Thus, the cold water period and hot water period may be determined according to the selected wash fluid temperature (e.g., extra hot, hot, warm, cold, etc.) for a fill segment of a wash cycle. Optionally, the cold water and hot water periods may be predetermined to correspond to selected wash fluid temperatures or adjusted according to one or more measured temperatures within the wash tub.

In some embodiments, cold water and hot water periods are determined to provide a ratio based on the selected wash fluid temperature. In order to meet the ratio, the cold water valve may be opened to flow cold water to the wash tub for a portion of the predetermined fill index, while the hot water valve is opened to flow hot water to the wash tub for another (e.g., different) portion of the predetermined fill index. For instance, the predetermined fill index may include both a cold water period in which the cold water valve is open, as well as a hot water period in which the hot water valve is open. Outside of the cold water period during the predetermined fill index, the cold water valve may be closed. Similarly, outside of the hot water period during the predetermined fill index, the hot water valve may be closed. As would be understood in light of the present disclosure, if a cold water cycle is selected, it is possible that no hot water period will be provided and predetermined fill index will only include a cold water period.

At 720, the method 700 includes executing the predetermined fill index. Specifically, once the predetermined fill index is initiated following 710, cold and hot water valves may be opened/closed according to 710. Concurrently with the opening/closing of cold and hot water valves, a wash additive may be directed to the wash tub, as described above.

For instance, the predetermined fill index may include a period or portion (i.e., segment) in which wash additive is to be directed to the water supply conduit (e.g., cold water conduit). In other words, the predetermined fill index may include a predetermined additive segment. Moreover, the predetermined fill index may include a period or portion (i.e., segment) in which wash additive may be prevented from flowing to the water supply conduit (e.g., cold water conduit). In other words, the predetermined fill index may include a non-additive segment. Such a non-additive segment of thus falls or occurs outside of the additive segment.

Generally, the predetermined fill index continues until the predetermined fill index is determined to expire. For instance, the period of time defining the predetermined index (e.g., measured from the initiation of the predetermined index) may end.

At 730, the method 700 includes determining if a target fluid level has been reached once the predetermined fill index expires (i.e., 720 ends).

Generally, a fluid level within the wash tub may be detected and compared to the target fluid level. Failing to meet or exceed the target fluid level may indicate the wash tub has not been adequately filled. Thus, in response to a detected fluid level that is less than the target fluid level, the method 700 may return to 710. By contrast, meeting or exceeding the target fluid level may indicate the wash tub has been adequately filled. Thus, in response to a detected fluid level that is greater than or equal to the target fluid level, the method 700 may proceed or advance to another portion of a wash cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet;

a wash tub positioned within the cabinet;

a wash basket rotatably mounted within the wash tub, the wash basket defining a wash chamber for receiving articles for washing;

an additive dispensing assembly positioned within the cabinet and configured to provide wash fluid to the wash tub, the additive dispensing assembly comprising a water supply valve to selectively direct water to the wash tub, a water supply conduit extending between the water supply valve and the wash tub, and an additive dispenser for storing and dispensing a wash additive, the additive dispenser being in selective fluid communication with the water supply conduit upstream of the wash tub; and a controller in operative communication with the additive dispensing assembly, the controller being configured to initiate a washing operation, the washing operation comprising opening the water supply valve for a first index according to a predetermined fill index, directing a wash additive from the additive dispenser to the water supply conduit during an additive segment of the first index according to a predetermined additive segment of the predetermined fill index, blocking the wash additive from the additive dispenser to the water supply conduit during a non-additive segment of the first index, detecting a fluid level within the wash tub following the first index, comparing the detected fluid level within the wash tub to a target fluid level, opening the water supply valve for a second index according to the predetermined fill index based on comparing the detected fluid level within the wash tub to the target fluid level, directing the wash additive from the additive dispenser to the water supply conduit during an additive segment of the second index, and blocking the wash additive from the additive dispenser to the water supply conduit during a non-additive segment of the second index, wherein the predetermined fill index is a set period of water flow or volume, and wherein the predetermined fill index is consistent between the first index and the second index.

2. The washing machine appliance of claim 1, wherein directing occurs at an initial portion of the predetermined fill index and ends prior to expiration of the predetermined fill index.

3. The washing machine appliance of claim 1, wherein the water supply conduit is a cold water supply conduit, wherein the water supply valve is a cold water valve, wherein the washing machine appliance further comprises a hot water supply conduit extending between a hot water valve and the wash tub in fluid parallel to the cold water supply conduit.

4. The washing machine appliance of claim 3, wherein the washing operation further comprises opening the hot water valve for a first hot water period according to the predetermined fill index.

5. The washing machine appliance of claim 1, wherein the washing machine further comprises a delivery channel extending from the additive dispenser to the water supply conduit.

6. The washing machine appliance of claim 5, wherein the water supply conduit comprises a Venturi nozzle downstream from the water supply valve to receive the delivery channel.

7. The washing machine appliance of claim 6, wherein the delivery channel is calibrated to provide a selected flow rate of the wash additive.

8. The washing machine appliance of claim 7, wherein the selected flow rate of the wash additive is proportional to a flow rate of a flow of water through the water supply conduit.

9. The washing machine appliance of claim 6, further comprising:

an additive valve positioned along the delivery channel for controlling a flow of the wash additive through the delivery channel, wherein directing the wash additive from the additive dispenser to the water supply conduit during the additive segment of the first index comprises opening the additive valve for the predetermined additive segment of the first index, and wherein blocking the wash additive from the additive dispenser to the water supply conduit during the non-additive segment of the first index comprises closing the additive valve outside of the predetermined additive segment of the first index.

10. The washing machine appliance of claim 6, further comprising:

a secondary pump in fluid communication with the additive dispenser upstream of the water supply conduit, wherein directing the wash additive from the additive dispenser to the water supply conduit during the additive segment of the first index comprises activating the secondary pump for the predetermined additive segment of the first index, and wherein blocking the wash additive from the additive dispenser to the water supply conduit during the non-additive segment of the first index comprises halting activation of the secondary pump outside of the predetermined additive segment of the first index.

11. A method of operating a washing machine appliance comprising a wash tub, a water supply conduit extending between a water supply valve and the wash tub, and an additive dispenser in selective fluid communication with the water supply conduit upstream of the wash tub, the method comprising:

opening the water supply valve for a first index according to a predetermined fill index;

directing a wash additive from the additive dispenser to the water supply conduit during an additive segment of the first index according to a predetermined additive segment of the predetermined fill index;

blocking the wash additive from the additive dispenser to the water supply conduit during a non-additive segment of the first index;

detecting a fluid level within the wash tub following the first index;

comparing the detected fluid level within the wash tub to a target fluid level;

opening the water supply valve for a second index according to the predetermined fill index based on comparing the detected fluid level within the wash tub to the target fluid level;

directing the wash additive from the additive dispenser to the water supply conduit during an additive segment of the second index; and blocking the wash additive from the additive dispenser to the water supply conduit during a non-additive segment of the second index, wherein the predetermined fill index is a set period of water flow or volume, and wherein the predetermined fill index is consistent between the first index and the second index.

12. The method of claim 11, wherein directing occurs at an initial portion of the predetermined fill index and ends prior to expiration of the predetermined fill index.

13. The method of claim 11, wherein the water supply conduit is a cold water supply conduit, wherein the water supply valve is a cold water valve, wherein the washing machine appliance further comprises a hot water supply conduit extending between a hot water valve and the wash tub in fluid parallel to the cold water supply conduit.

14. The method of claim 13, wherein the method further comprises opening the hot water valve for a first hot water period according to the predetermined fill index.

15. The method of claim 11, wherein the washing machine further comprises a delivery channel extending from the additive dispenser to the water supply conduit.

16. The method of claim 15, wherein the water supply conduit comprises a Venturi nozzle downstream from the water supply valve to receive the delivery channel.

17. The method of claim 15, wherein the delivery channel is calibrated to provide a selected flow rate of the wash additive.

18. The method of claim 17, wherein the selected flow rate of the wash additive is proportional to a flow rate of a flow of water through the water supply conduit.

19. The method of claim 15, wherein the washing machine appliance further comprises an additive valve positioned along the delivery channel for controlling a flow of the wash additive through the delivery channel, wherein directing the wash additive from the additive dispenser to the water supply conduit during the additive segment of the first index comprises opening the additive valve for the predetermined additive segment of the first index, and wherein blocking the wash additive from the additive dispenser to the water supply conduit during the non-additive segment of the first index comprises closing the additive valve outside of the predetermined additive segment of the first index.

20. The method of claim 15, wherein the washing machine appliance further comprises a secondary pump in fluid communication with the additive dispenser upstream of the water supply conduit, wherein directing the wash additive from the additive dispenser to the water supply conduit during the additive segment of the first index comprises activating the secondary pump for the predetermined additive segment of the first index, and wherein blocking the wash additive from the additive dispenser to the water supply conduit during the non-additive segment of the first index comprises halting activation of the secondary pump outside of the predetermined additive segment of the first index.

* * * * *